US008977145B2

(12) United States Patent
Lin

(10) Patent No.: US 8,977,145 B2
(45) Date of Patent: Mar. 10, 2015

(54) DETECTION DEVICE FOR DETECTING STATE OF WASTE TONER CONTAINER AND IMAGE FORMING APPARATUS USING SUCH DETECTION DEVICE

(71) Applicant: Avision Inc., Hsinchu (TW)

(72) Inventor: Chia-Shin Lin, Hsinchu (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 14/070,829

(22) Filed: Nov. 4, 2013

(65) Prior Publication Data

US 2014/0178083 A1 Jun. 26, 2014

(30) Foreign Application Priority Data

Dec. 25, 2012 (TW) ..... 101149684 A

(51) Int. Cl.
*G03G 21/12* (2006.01)

(52) U.S. Cl.
CPC ..... *G03G 21/12* (2013.01)
USPC ..... 399/35

(58) Field of Classification Search
USPC ..... 399/13, 35
See application file for complete search history.

(56) References Cited

U.S. PATENT DOCUMENTS

| | | | | |
|---|---|---|---|---|
| 4,761,674 | A | 8/1988 | Ogura | |
| 5,260,755 | A | 11/1993 | Imaizumi | |
| 7,742,708 | B2 * | 6/2010 | Fukusada | 399/12 |
| 8,380,117 | B2 | 2/2013 | Ohta | |
| 2004/0190918 | A1 * | 9/2004 | Park | 399/35 |
| 2008/0181633 | A1 * | 7/2008 | Oh | 399/35 |
| 2009/0116853 | A1 * | 5/2009 | Okazaki et al. | 399/12 |
| 2010/0166441 | A1 * | 7/2010 | Kobayashi | 399/35 |
| 2011/0103857 | A1 | 5/2011 | Ohta | |
| 2014/0112673 | A1 * | 4/2014 | Sayama | 399/35 |
| 2014/0178083 | A1 * | 6/2014 | Lin | 399/35 |

* cited by examiner

*Primary Examiner* — W B Perkey

(57) ABSTRACT

A detection device for detecting a state of a waste toner container comprises an optical sensor and an actuation member. The optical sensor comprises an emitting unit emitting an optical signal and a receiving unit receiving the optical signal. A space is provided between the emitting and receiving units, and the optical signal travels along an optical path from the emitting unit to the receiving unit. The actuation member is movably disposed between the emitting and receiving units. The actuation member in a first position interrupts the optical path of the optical signal; and the actuation member is moved by the waste toner container to a second position when at least a part of the waste toner container is placed in the space. The actuation member in the second position allows a passage of the optical signal. An image forming apparatus using such a detection device is also provided.

18 Claims, 11 Drawing Sheets

DETECTION DEVICE FOR DETECTING STATE OF WASTE TONER CONTAINER AND IMAGE FORMING APPARATUS USING SUCH DETECTION DEVICE

CROSS REFERENCE TO RELATED APPLICATIONS

This application claims the benefit of the foreign application priority of Taiwan Application No. 101149684, which was filed on Dec. 25, 2012 and is incorporated herein by reference.

BACKGROUND OF THE INVENTION

1. Field of the Invention

The present invention relates to a detection device for detecting a state of a waste toner container and an image forming apparatus using such a detection device, and, more particularly, to a detection device for detecting both the presence and loading level of the waste toner container and the image forming apparatus using such a detection device.

2. Description of the Prior Art

A conventional image forming apparatus detects the loading level of the waste toner container by different ways, such as detecting the optical signals, weight or pressure or the use of other mechanisms. U.S. Pat. No. 4,761,674 discloses a device disposed in the waste toner container, and the device comprises a flexible film with a reflection plate. The reflection plate reflects light to a sensor when the container is full of waste toner. However, the device isn't able to detect a nearly full state of the waste toner container. A device with an electric balance detecting the weight of the waste toner container is disclosed by U.S. Pat. No. 5,260,755. The device detects the weight of the waste toner and turns the detecting result into an electrical signal, and is able to detect the loading level of the container precisely. But it should be known that the cost of the electric balance is expensive. U.S. Pat. No. 8,380,117 discloses an image forming apparatus with a detecting bar for detecting the loading level. However, the structure of the apparatus is very complicated.

In addition, it is also important to detect the presence of the waste toner container. The waste toner will be scattered in the image forming apparatus if the user makes the apparatus print and isn't aware of the absence of the container. It causes the worse quality of printing and even damages the image forming apparatus.

SUMMARY OF THE INVENTION

Therefore, an objective of the invention is to provide a detection device for detecting a state of a waste toner container, which is a simple mechanism to detect both the presence and the loading level of the waste toner container. And the cost is few to detect multiple states of the container. Besides, an image forming apparatus using such a detection device is also provided.

A detection device for detecting a state of a waste toner container is provided in the present invention which comprises a first optical sensor and an actuation member. The first optical sensor comprises a first emitting unit and a first receiving unit. The first emitting unit is configured to emit a first optical signal, and the first receiving unit is configured to receive the first optical signal. A space for installation of the waste toner container is provided between the first emitting unit and the first receiving unit. The first optical signal travels along an optical path from the first emitting unit to the first receiving unit. The actuation member is movably disposed between the first emitting unit and the first receiving unit. The actuation member in a first position interrupts the optical path of the first optical signal; and the actuation member is moved by the waste toner container to a second position when at least a part of the waste toner container is placed in the space between the first emitting unit and the first receiving unit. The actuation member in the second position allows a passage of the first optical signal.

An image forming apparatus using such a detection device is also provided in the present invention and comprises a printing engine, a waste toner container and said device.

These and other objectives of the present invention will no doubt become obvious to those of ordinary skill in the art after reading the following detailed description of the preferred embodiment that is illustrated in the various figures and drawings.

DETAILED DESCRIPTION

Embodiments of the present invention will be described below with reference to the accompanying drawings.

Figure 1:
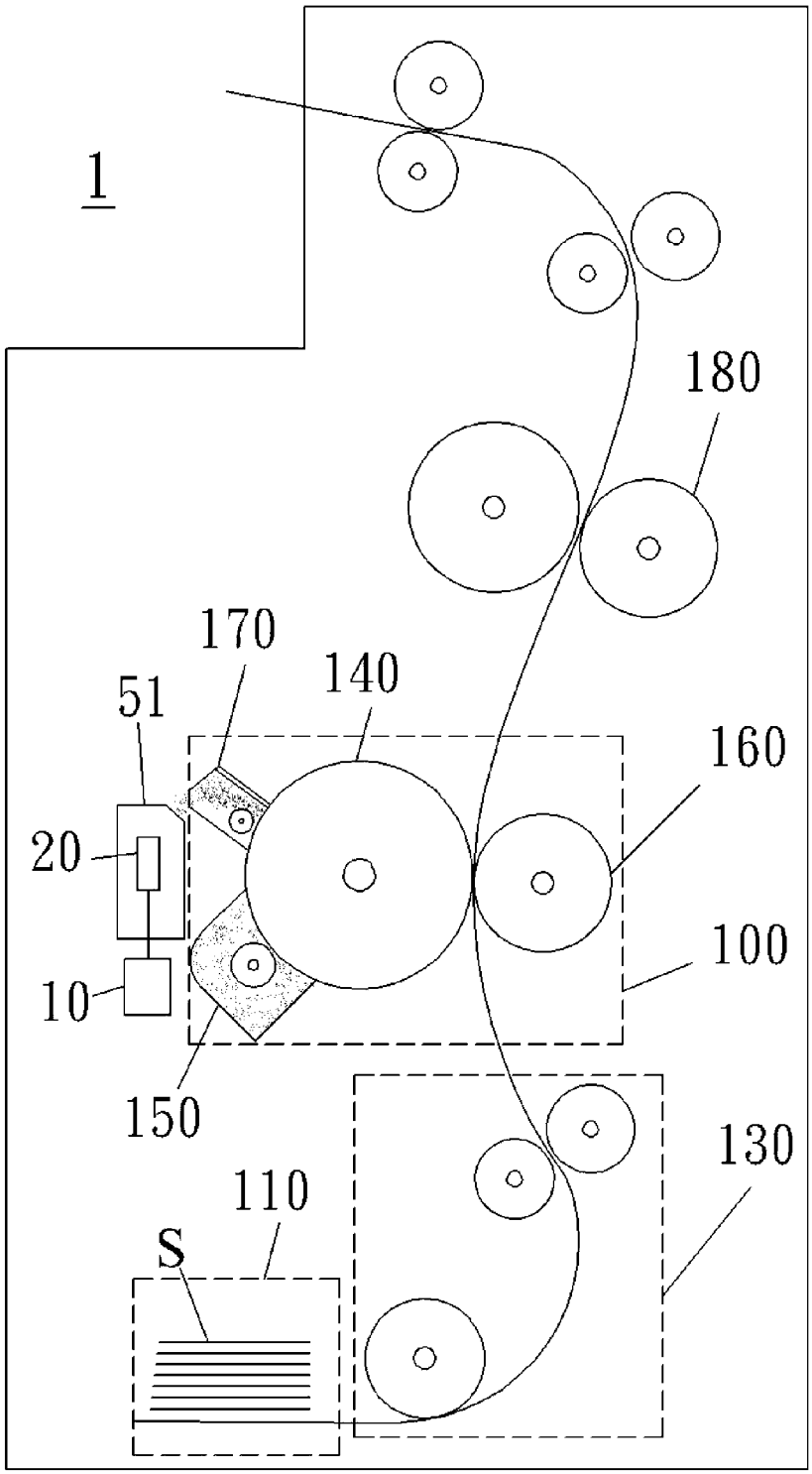
FIG. 1 is a diagram of an image forming apparatus according to an embodiment of the present invention.

FIG. 1 is a diagram of an image forming apparatus according to an embodiment of the present invention. Referring to FIG. 1, the image forming apparatus 1 comprises a printing engine 100, a paper cassette 110, a paper transferring system 130, a fixing roller set 180, a waste toner container 51, a detection device 20, and a processor 10. The printing engine 100 comprises a photosensitive drum 140, a developing unit 150, a transfer roller 160, and a cleaner 170. The paper transferring system 130 transfers a paper S from the paper cassette 110 to the printing engine 100. The toner in the developing unit 150 is attracted to the photosensitive drum 140. When the paper S passes through the photosensitive drum 140, the photosensitive drum 140 rotates and transfers the toner to the paper with the transfer roller 160. The fixing roller set 180 fuses the toner and fixes it on the paper S by thermal and pressure. After the paper S goes through the printing engine 100 and the fixing roller set 180, it is discharged from the image forming apparatus 1. As the photosensitive drum 140 finishes transferring, the photosensitive drum 140 rotates to the cleaner 170 which removes the waste toner from the surface of the photosensitive drum 140. The waste toner container 51 for gathering and storing the waste toner from the printing engine 100 is detachably disposed to one side of the printing engine 100. The user will take out the waste toner container 51 and put in a new one if the old one is full. The detection device 20 is for detecting a state of the waste toner container 51, for example, the presence or the loading level, or both. The processor 10 determines the state of the waste toner container 51 and then controls the image forming apparatus 1 according to the detecting results of the detection device 20.

Figure 2:
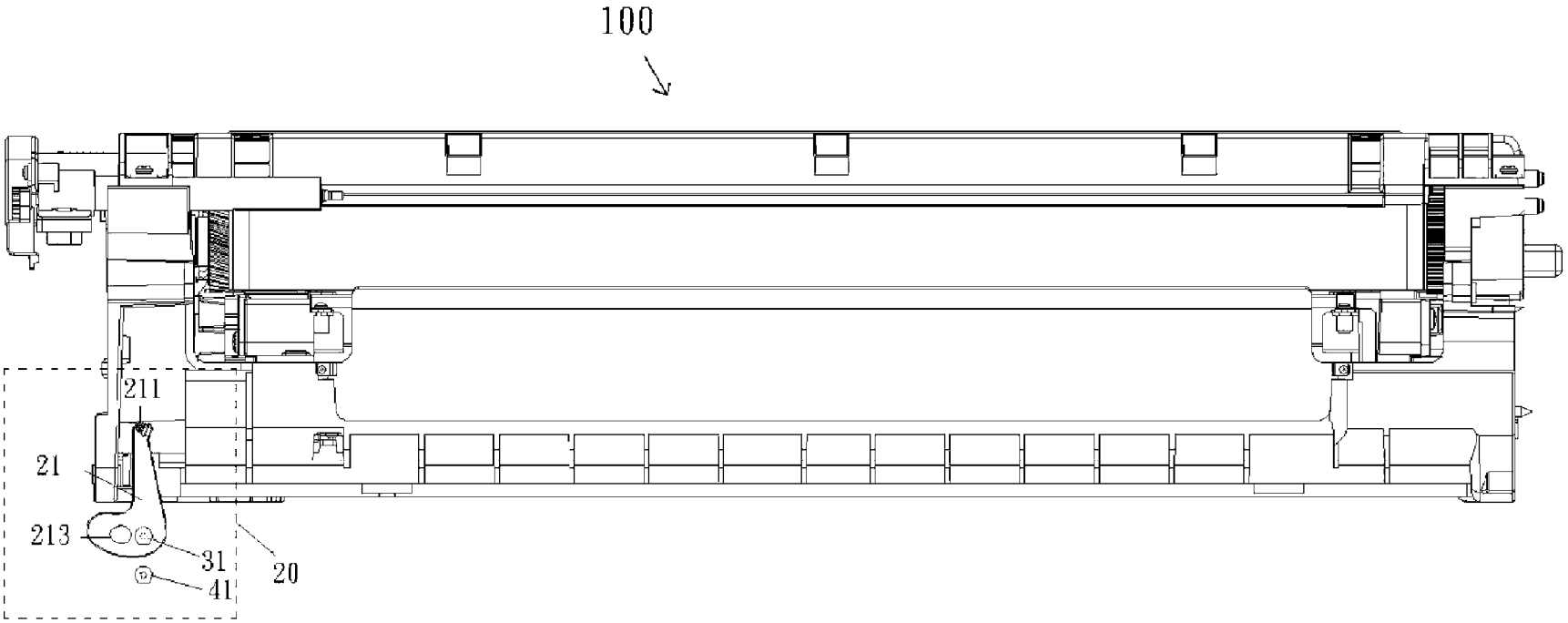
FIG. 2 is a front view of the printing engine and detection device shown in FIG. 1, where the waste toner container is absent.
Figure 5:
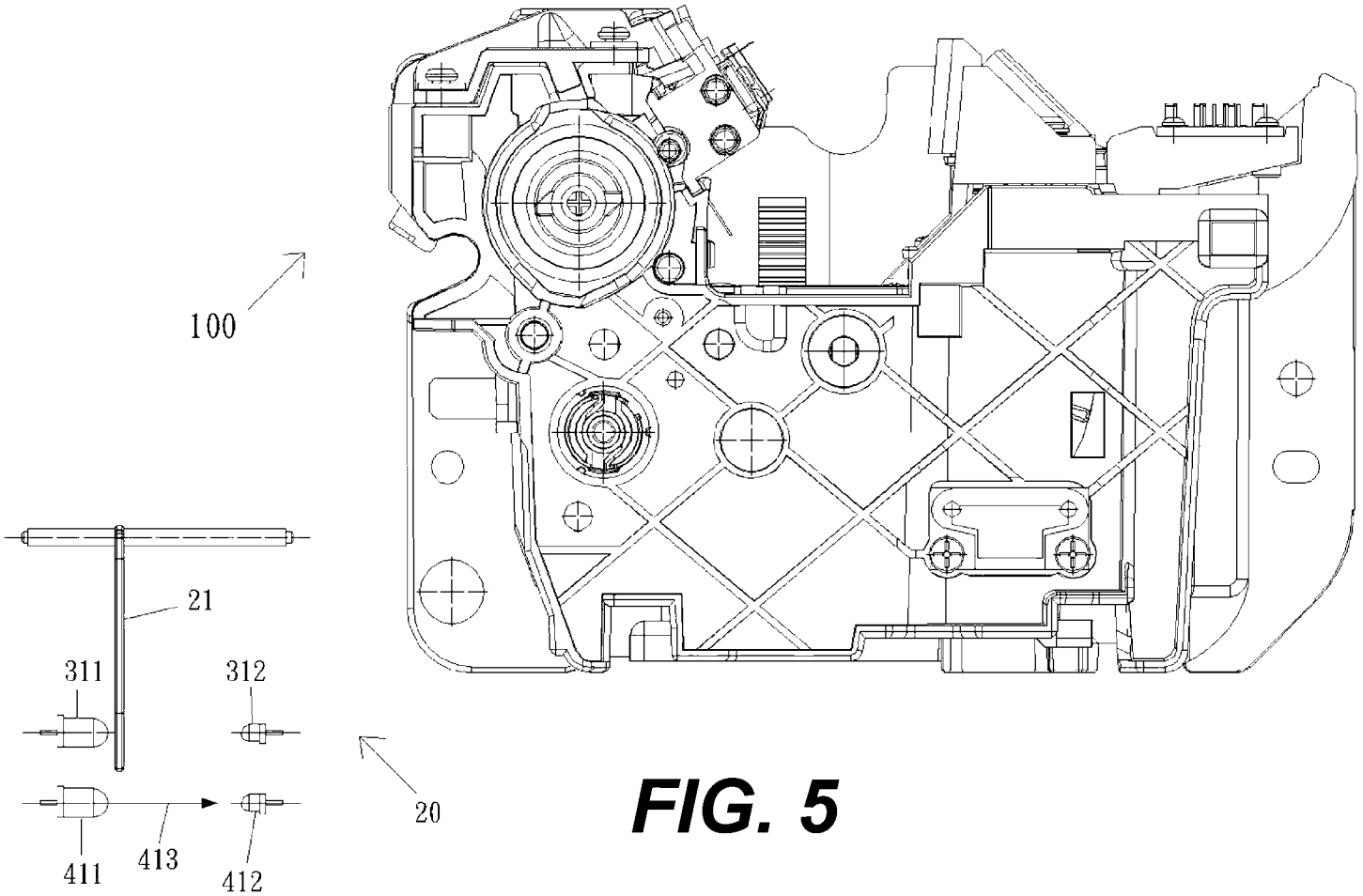
FIG. 5 is a right side view of the printing engine and detection device shown in FIG. 2.

FIG. 2 is a front view of the printing engine and detection device shown in FIG. 1, where the waste toner container is absent. FIG. 5 is a right side view of the printing engine and detection device shown in FIG. 2. Referring to FIG. 2 and FIG. 5, the detection device 20 is disposed to one side of the printing engine 100. A space for installation the waste toner container 51 is provided between the detection device 20 and the printing engine 100. The detection device 20 comprises a first optical sensor 31, a second optical sensor 41, and an actuation member 21. The first optical sensor 31 comprises a first emitting unit 311 configured to emit a first optical signal 313, and a first receiving unit 312 configured to receive the first optical signal 313. The second optical sensor 41 disposed below the first optical sensor 31 and comprises a second emitting unit 411 configured to emit a second optical signal 413, and a second receiving unit 412 configured to receive the second optical signal 413. The space is provided between the first emitting unit 311 and the first receiving unit 312, and the first optical signal 313 travels along an optical path from the first emitting unit 311 to the first receiving unit 312. A space is also provided between the second emitting unit 411 and the second receiving unit 412, and the second optical signal 413 travels along another optical path from the second emitting unit 411 to the second receiving unit 412. The first optical sensor 32 is used for detecting a loading level of the waste toner container 51, and the second optical sensor 41 is used for detecting a warning level, which is under the loading level. Furthermore, the first optical sensor 31 and the second optical sensor 41 can detect the presence of the waste toner container 51 with the aid of the actuation member 21.

The actuation member 21 is movably disposed between the first emitting unit 311 and the first receiving unit 312. Referring to FIG. 2, the actuation member 21 in a first position interrupts the optical path of the first optical signal 313 while the waste toner container 51 is absent. The actuation member 21 is formed with an aperture 213 and pivotally mounted to a pivot 211 for pivotal movement. The aperture 213 makes the first optical signal 313 pass through the actuation member 21. However, the aperture 213 isn't on the optical path of the first optical signal 313 when the actuation member 21 is in the first position. As a result, the first optical signal 313 doesn't pass through the actuation member 21, and is interrupted by the opaque part of the actuation member 21. The details will be given below. On the contrary, the second optical sensor 41 is disposed below the first optical sensor 31, and the actuation member 21 isn't able to interrupt the second optical signal 413.

Referring to FIG. 5, the actuation member 21 is disposed between the first emitting unit 311 and the first receiving unit 312. The second emitting unit 411 and the second receiving unit 412 are disposed below the first emitting unit 311 and the first receiving unit 312, but not limited to the right below direction. The first optical signal 313 is interrupted by the actuation member 21 when the waste toner container 51 is absent. However, the second optical signal 413 is received by the second receiving unit 412 without interrupting. As a result, the absence of the waste toner container 51 in an installed position is detected if the first receiving unit 312 receives no first optical signal 313 and the second receiving unit 412 receives the second optical signal 413. The processor 10 determines that the waste toner container 51 is absent on the basis of the detecting result. The processor 10 is able to send a warning signal by displaying or light, to notify the user that the image forming apparatus 1 needs a waste toner container 51. The processor 10 also can send a breaking signal to stop the operation for preventing waste toner spreading and staining the surrounding.

Figure 3:
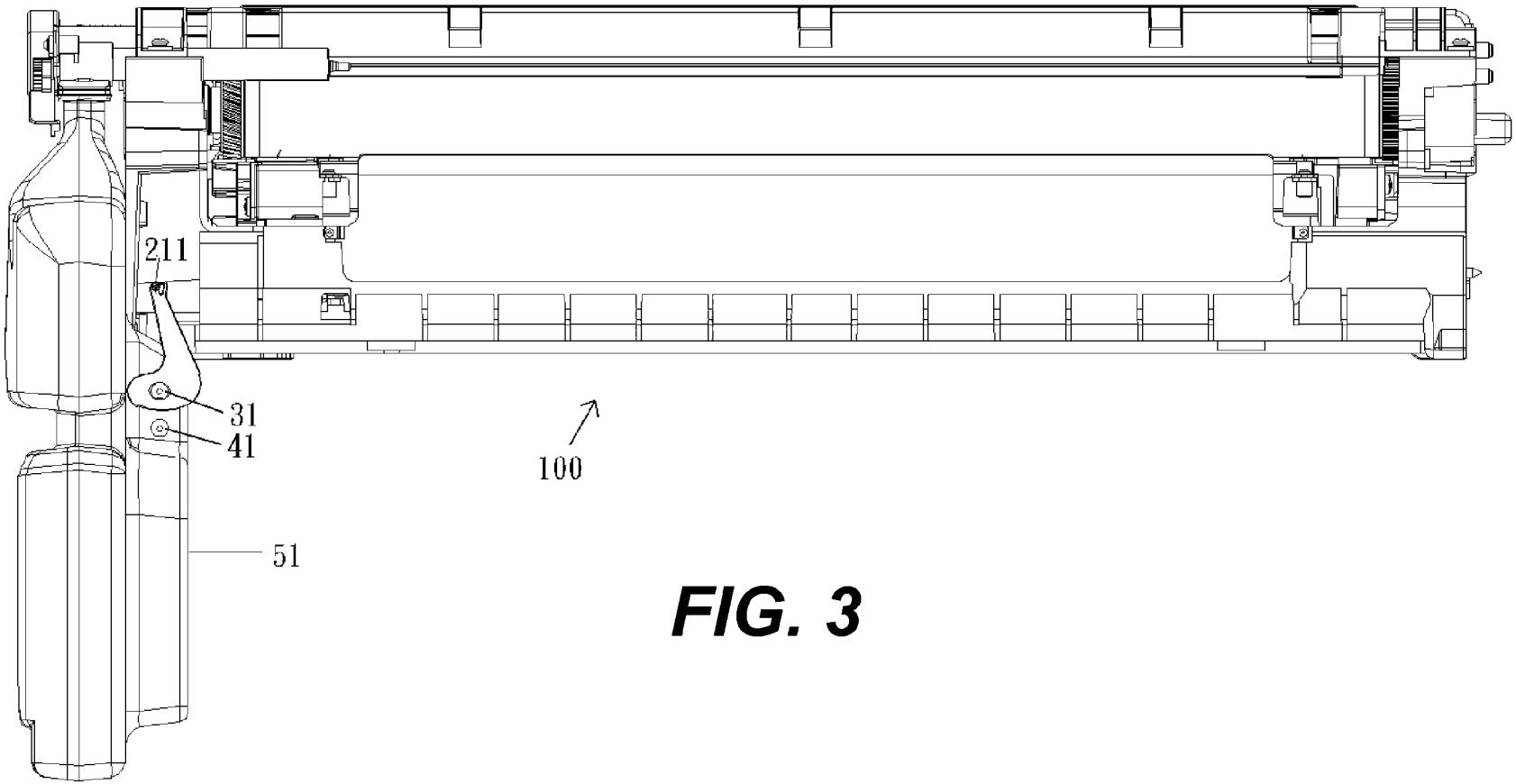
FIG. 3 is another front view of the printing engine and detection device shown in FIG. 1, where the waste toner container is present.
Figure 4:
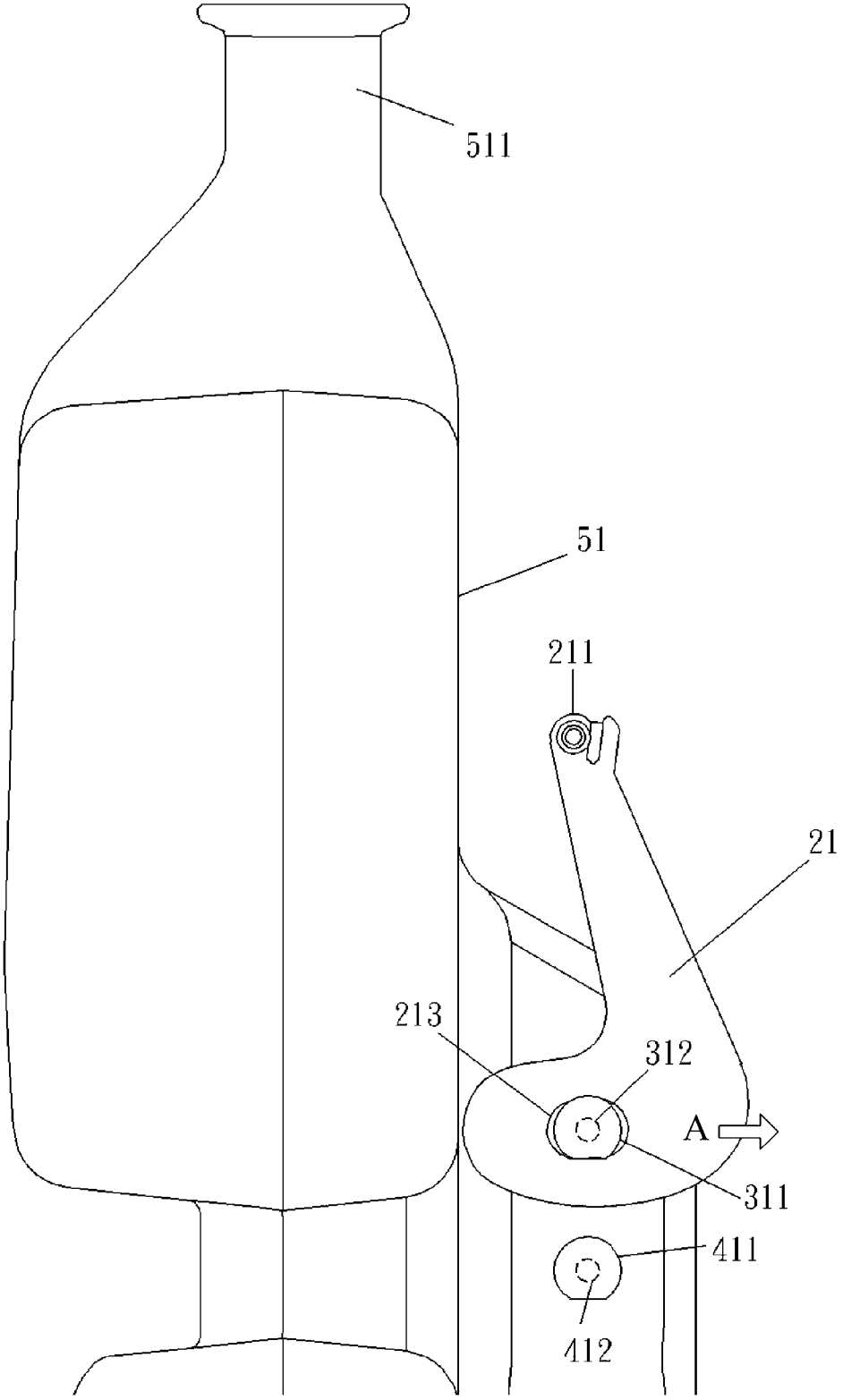
FIG. 4 is an enlarged partial view showing the waste toner container and the detection device shown in FIG. 3.

FIG. 3 is another front view of the printing engine and detection device shown in FIG. 1, where the waste toner container is present. FIG. 4 is an enlarged partial view showing the waste toner container and the detection device shown in FIG. 3. Referring to FIG. 3 and FIG. 4, the actuation member 21 is moved by the waste toner container 51 to a second position when the waste toner container 51 is in the installed position, or at least a part of the waste toner container 51 is placed in the space between the first emitting unit 311 and the first receiving unit 312. The actuation member 21 is pushed along a moving direction A to the second position when it is installed. The actuation member 21 in the second position allows a passage of the first optical signal 313. In addition, there are different members, apparatus, or methods which are also able to make the actuation member 21 move off the first position. For example, magnets may be attached to the waste toner container 51 and the actuation member 21 respectively. By the repulsion oflike poles, the actuation member 21 is pushed and moved off the first position while the waste toner container 51 is installed and approaches. Or, a solenoid valve which controls the actuation member 21 may be set in the first position or the second position. As the actuation member 21 is moved by the waste toner container 51 to the second position, the aperture 213 also moves into the optical path of the first optical signal 313. The first optical signal 313 passes through the aperture 213 toward the waste toner container 51 which is installed. The aperture 213 can be replaced by other structures, like a gap, a piece of transparent material, or a designed shape which makes the first optical signal 313 pass through the actuation member 21.

Figure 6:
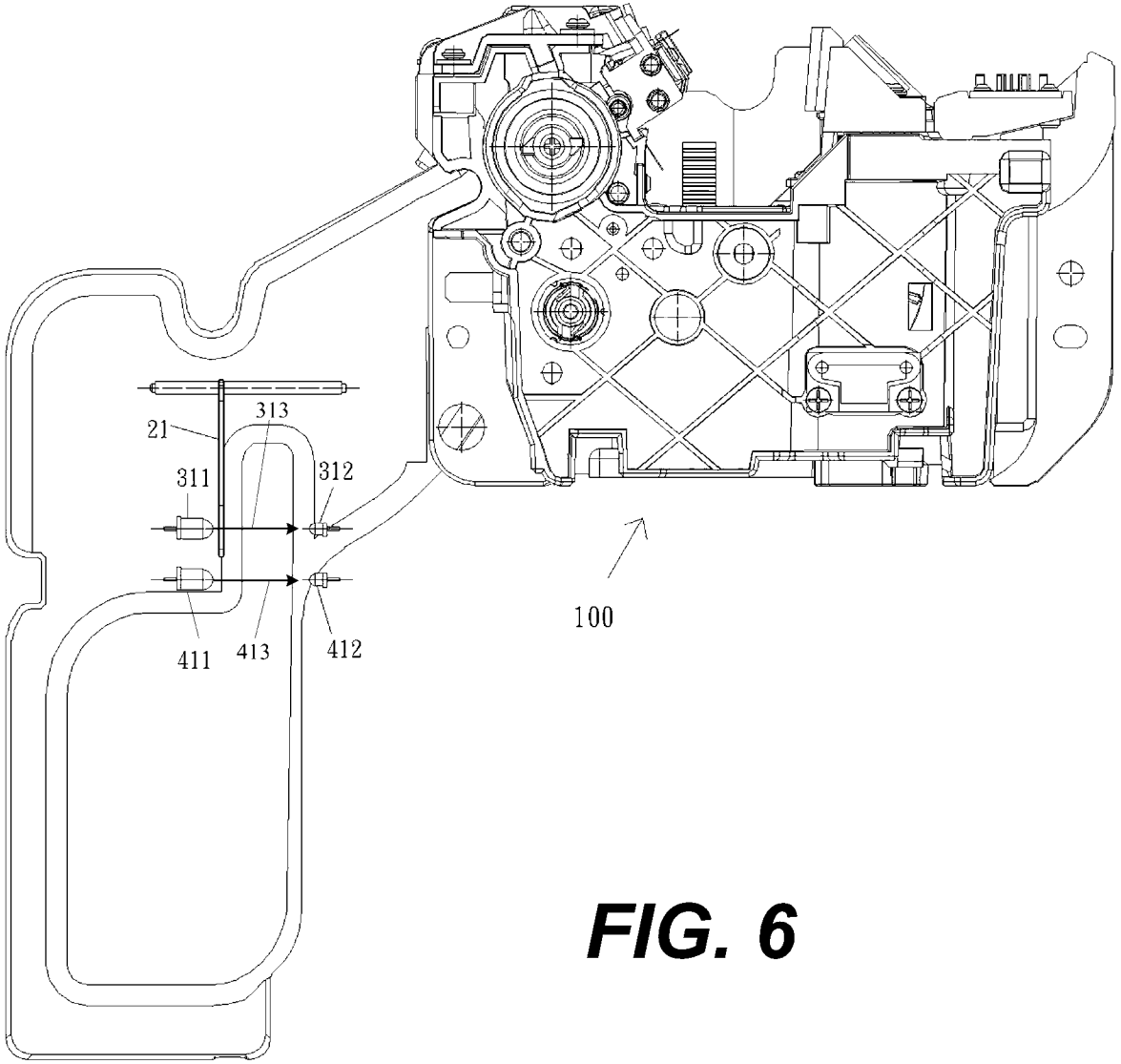
FIG. 6 is a right side view of the printing engine and detection device shown in FIG. 3.

In the embodiment, the waste toner container 51 is able to transmit light. Therefore, when the vacant waste toner container 51 is installed, both the first optical signal 313 and the second optical signal 413 pass through the waste toner container 51 and arrive to the first receiving unit 312 and the second receiving unit 412 respectively. FIG. 6 is a right side view of the printing engine and detection device shown in FIG. 3. Referring to FIG. 6, after the waste toner container 51 is installed, the first optical signal 313 passes through the aperture 213 and toward the waste toner container 51. As a result, the presence of the waste toner container 51 in the installed position is detected if the first receiving unit 312 and the second receiving unit 412 receive the first optical signal 313 and the second optical signal 413 respectively. The processor 10 determines the waste toner container 51 is installed to the image forming apparatus 1 according to the detecting result. The waste toner container 51 would be composed of transparent material; or only part of regions of the waste toner container 51 is transparent. The transparent regions are faced to the first optical sensor 31 and the second optical sensor 41, respectively. The transparent regions make the first optical signal 313 and the second optical signal 423 pass through the waste toner container 51.

Figure 7:
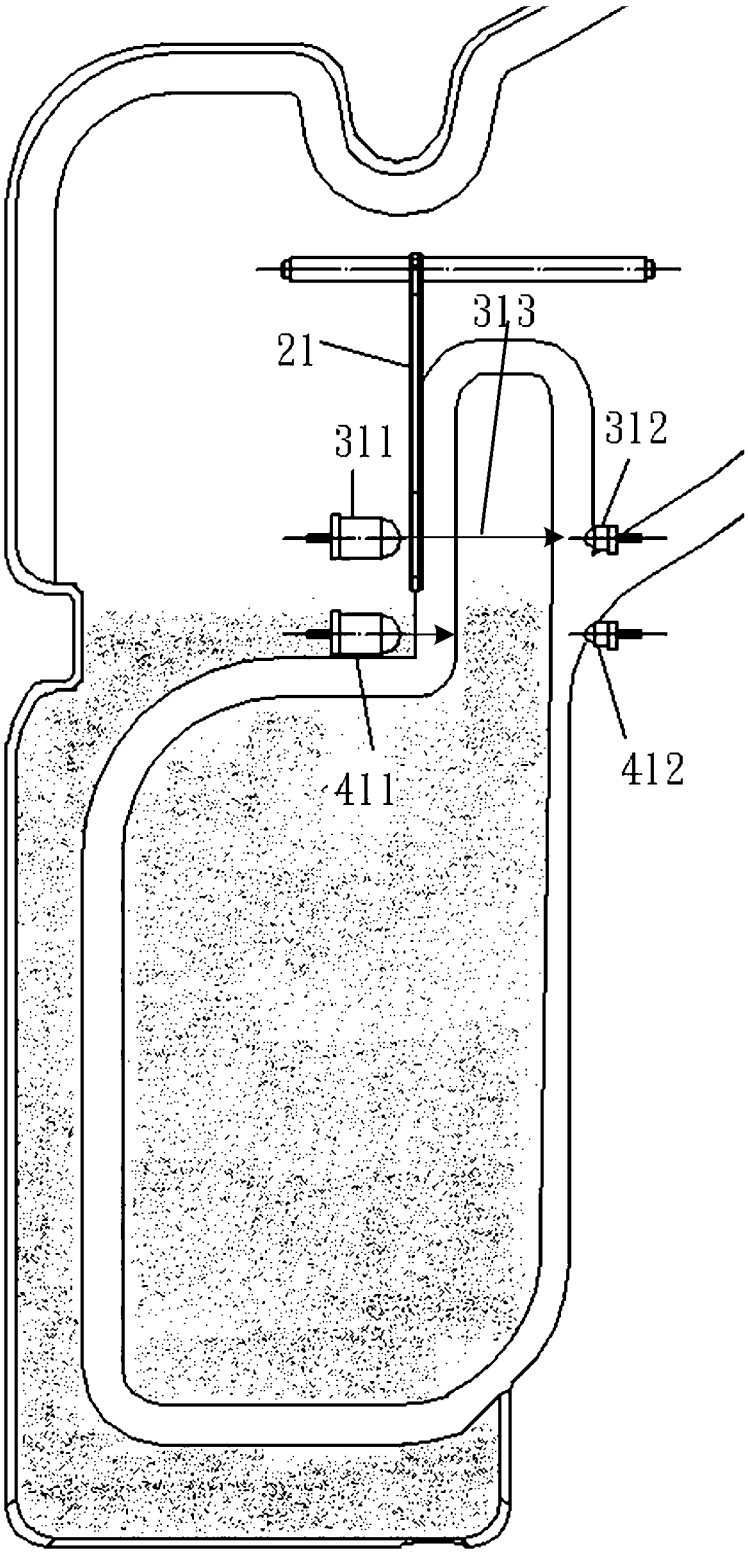
FIG. 7 is aperspective view of the waste toner container and detection device shown in FIG. 6, where the waste toner container is filled to the warning level.

The first optical sensor 31 for detecting a loading level of the waste toner container 51 is disposed at an upper position. The second optical sensor 41 for detecting a warning level of the waste toner container 51 is disposed at a lower position. The warning level can be the level of 70% loading. It means that the waste toner container 51 is nearly full when the warning level is achieved, and it means full when the loading level is achieved. FIG. 7 is a perspective view of the waste toner container and detection device shown in FIG. 6, where the waste toner container is filled to the warning level. The waste toner is piled up and makes the waste toner container 51 full after the image forming apparatus 1 operates. Referring to FIG. 7, the opaque waste toner piled up to/over the warning level makes the second optical signal 413 fail to pass through the waste toner container 51. In this case, a nearly full state in the waste toner container 51 in the installed position is detected if the first receiving unit 312 receives the first optical signal 313 and the second receiving unit 412 receives no second optical signal 413. The processor 10 determines that the waste toner container is nearly full according to the detecting result. Then the processor 10 controls the image forming apparatus 1 to send a signal to remind the user to prepare replacing the waste toner container 51.

Figure 8:
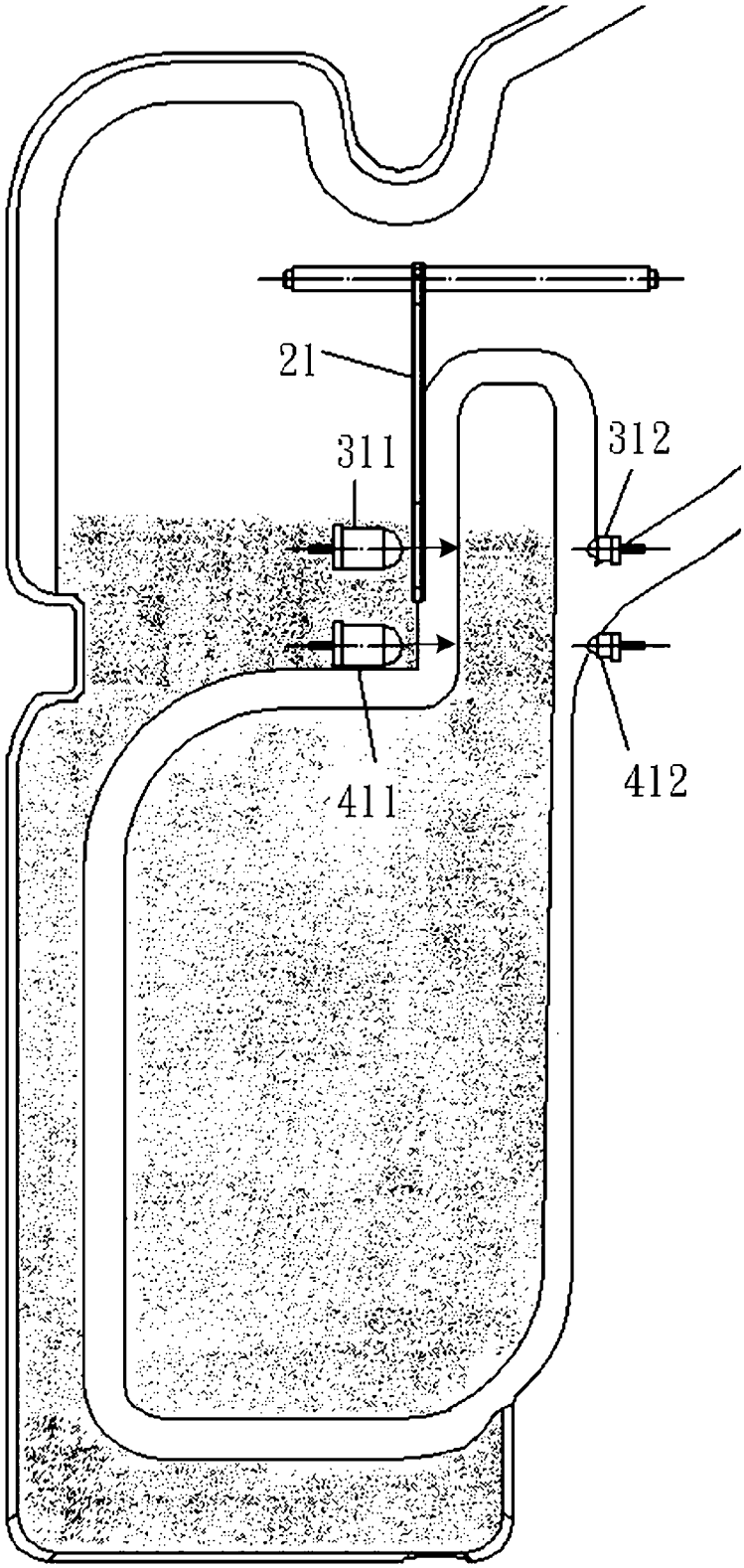
FIG. 8 is aperspective view of the waste toner container and detection device shown in FIG. 6, where the waste toner container is full-loaded.

FIG. 8 is aperspective view of the waste toner container and detection device shown in FIG. 6, where the waste toner container is full-loaded. Referring to FIG. 8, the waste toner container 51 is full, as the waste toner is piled up to the loading level blocking both the first optical signal 313 and the second optical signal 413. A full state in the waste toner container in the installed position is detected if neither of the first receiving unit 312 and the second receiving unit 412 receives the optical signal. The processor 10 determines that the waste toner is full, according to the detecting result. Similarly, the processor 10 controls the image forming apparatus 1 to send a signal to remind the user to replace the waste toner container 51. The processor 10 is also able to order the image forming apparatus 1 to stop printing, for keeping the waste toner from spreading. The spreading waste toner is able to damage the image forming apparatus 1 and lower the quality of printing. It is not out of the invention to dispose the first optical sensor 31 and the second optical sensor 41 in other positions for detecting different levels.

As shown in FIG. 4, there is a collecting port 511 on the top of the waste toner container 51. The waste toner scraped by the cleaner 170 (shown in FIG. 1) is fed into the waste toner container 51 by passing through the collecting port 511. As a result, the waste toner piles up within the waste toner container 51. Besides, a third optical sensor is provided and disposed under the second optical sensor 41 if the image forming apparatus 1 is designed to detect another level, for example, the level of 60% loading.

Figure 9:
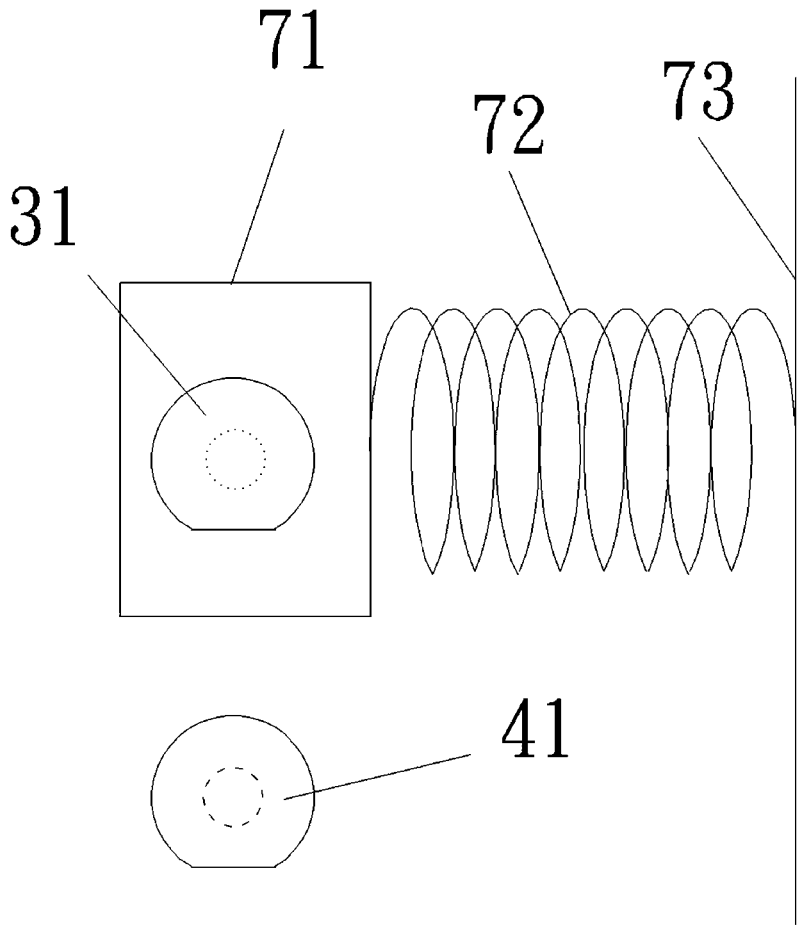
FIG. 9 is a diagram of another example of the actuation member, where the waste toner container is absent.
Figure 10:
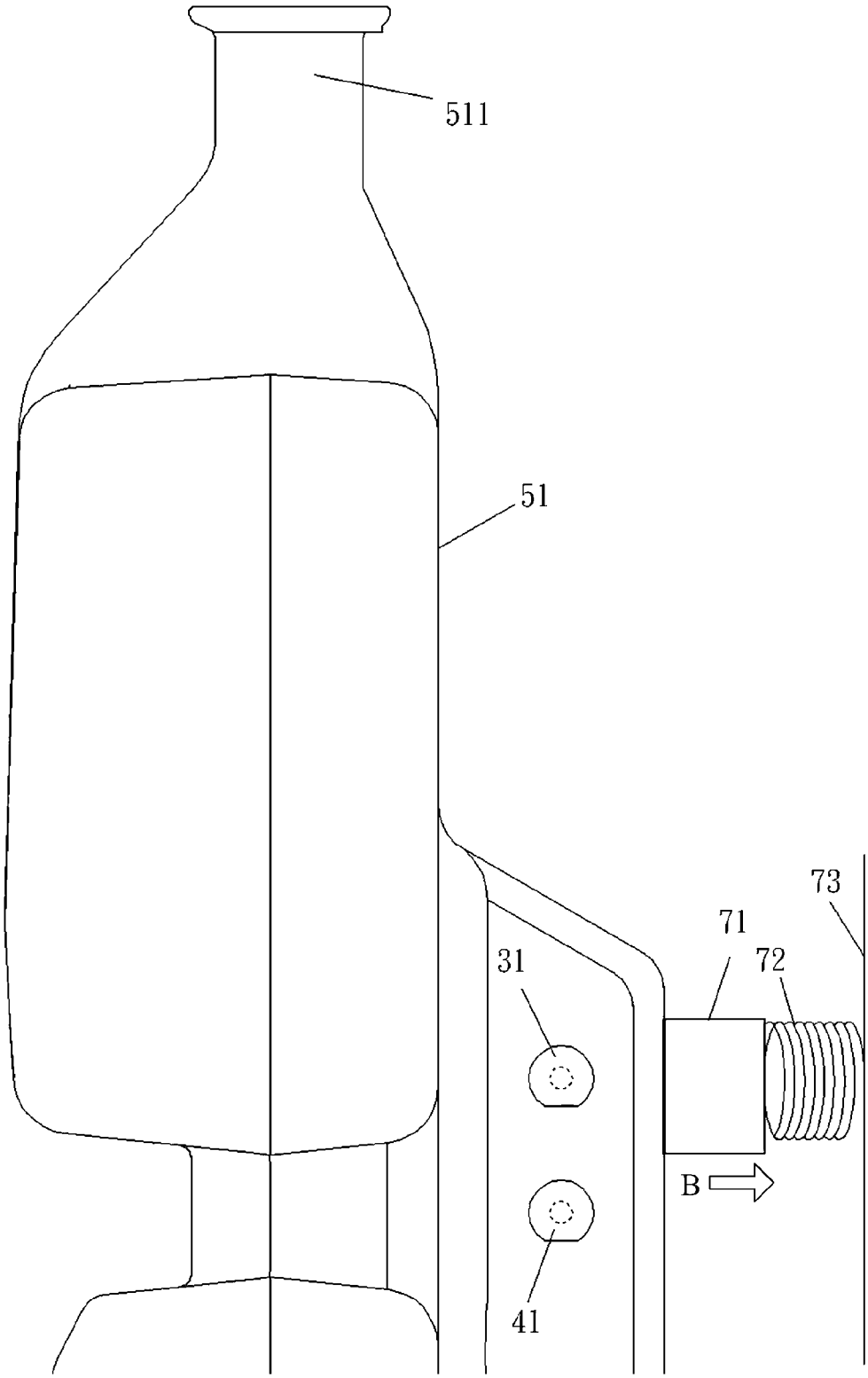
FIG. 10 is a diagram of the actuation member shown in FIG. 9, where the waste toner container is present.

The actuation member 21 can be replaced by another example of actuation member 71 in the embodiment. FIG. 9 is a diagram of another example of the actuation member, where the waste toner container is absent. Referring to FIG. 9, the detection device further comprises an elastic connecting member 72 which connects the actuation member 71 to a frame 73 of the image forming apparatus 1. By the elastic connecting member 72, the actuation member 71 is flexibly disposed between the first emitting unit 311 and the first receiving unit 312. The actuation member 71 is at a first position blocking the first optical signal 313 if the waste toner container 51 is absent. FIG. 10 is a diagram of the actuation member shown in FIG. 9, where the waste toner container is present. Referring to FIG. 10, when the waste toner container 51 is installed, it pushes the actuation member 71 and compresses the elastic connecting member 72. The actuation member 71 is pushed along a moving direction B to a second position. At the second position, the actuation member 71 is out of the optical path of the first optical signal 313 and allows the passage of the first optical signal 313. When the waste toner container 51 is removed, the actuation member 71 comes back to the first position by the recovery of the elastic connecting member 72, as shown in FIG. 9. The mechanism of detecting the loading level of the waste toner container 51 is the same as the detection device 20 having the actuation member 21. So the detail of the detecting mechanism isn't given again.

Figure 11:
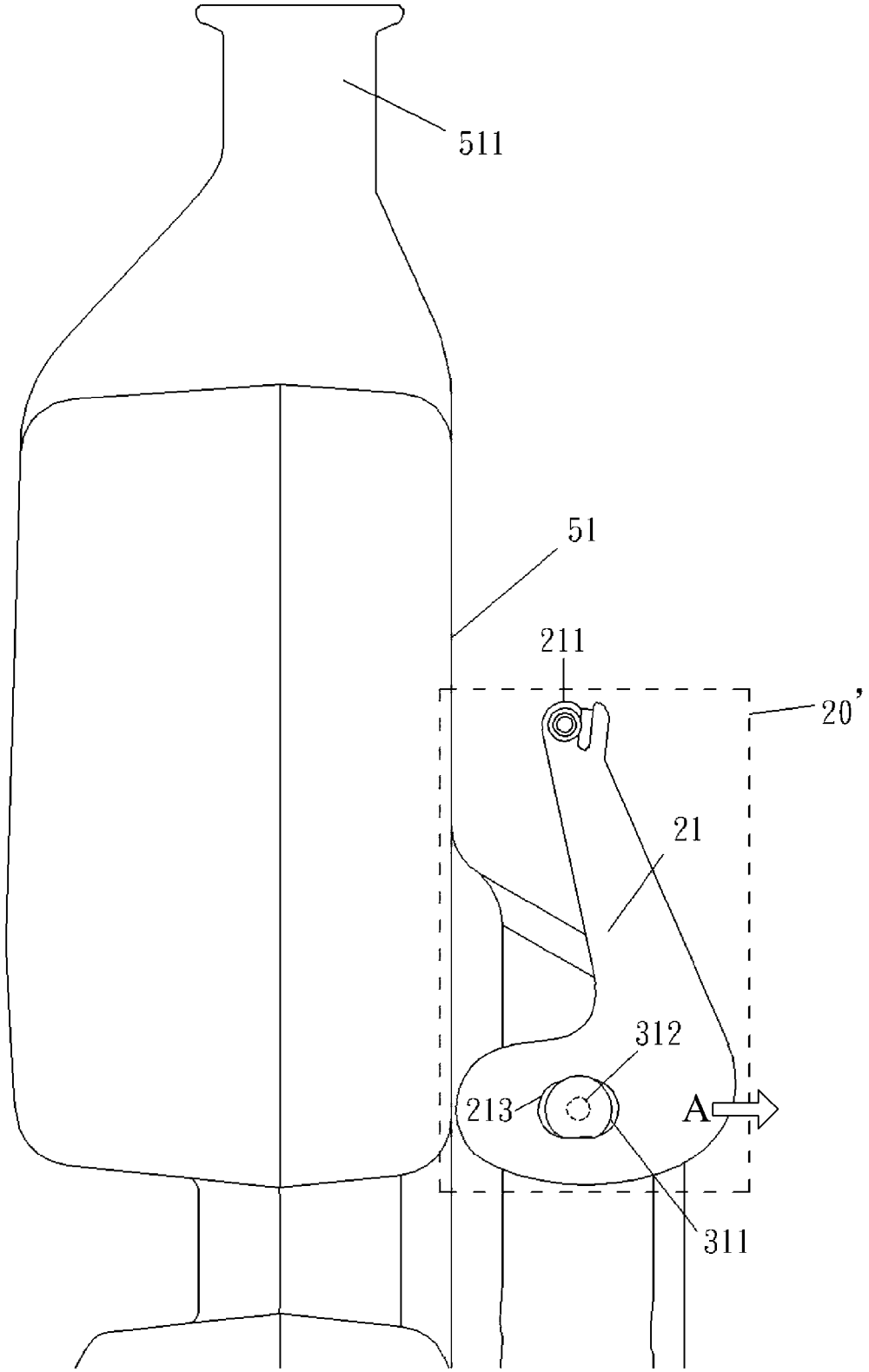
FIG. 11 is a diagram of a detection device according to another embodiment of the present invention.

FIG. 11 is a diagram of a detection device according to another embodiment of the present invention. Referring to FIG. 11, the detection device 20 comprises the actuation member 21 and the first optical sensor 31 without the second optical sensor 41. The first optical sensor 31 comprises a first emitting unit 311 configured to emit a first optical signal 313, and a first receiving unit 312 configured to receive the first optical signal 313. The space is provided between the first emitting unit 311 and the first receiving unit 312, and the first optical signal 313 travels along an optical path from the first emitting unit 311 to the first receiving unit 312. The actuation members 21 in the embodiment and in the first embodiment are the same, and the actuation member 21 also can be replaced by the actuation member 71. The detail about the actuation members 21 and 71 can be found in the first embodiment and will be omitted here.

The actuation member 21 is moved by the waste toner container 51 to a second position when the waste toner container 51 is in the installed position. The presence of the waste toner container 51 in the installed position is detected if the first receiving unit 312 receives the first optical signal 313. And the absence of the waste toner container 51, or a full state in the waste toner container 51, is detected if the first receiving unit 312 receives no first optical signal 313. In this embodiment, it is hard to detect the warning level (nearly full state) before full, and is hard to distinguish between the full state and the absence of the waste toner container 51. However, it is still useful to warn users to check the state of the waste toner container 51. When the first receiving unit 312 receives no first optical signal 313, the processor 10 controls the image forming apparatus 1 to send a signal to remind the user to check the state of the waste toner container 51, or orders the image forming apparatus 1 to stop printing.

Compared with the present invention, the conventional image forming apparatus detecting the loading level (full state) of the waste toner container is more complex and costs high price. If the conventional image forming apparatus is expected to detect the presence of the waste toner container, it needs to be equipped with other devices. On the contrary, the present invention costs lower price with simple structure. The present invention can detect both the presence and the loading of the waste toner container without other devices or assembling steps. It is able to remind the user that the waste toner container is nearly full by detecting a warning level. Compared with the other device which is only able to detect one state, the present invention can detect both two states and protect the image forming apparatus and the quality of printing more completely.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A detection device for detecting a state of a waste toner container, comprising:

a first optical sensor comprising a first emitting unit configured to emit a first optical signal and a first receiving unit configured to receive the first optical signal, wherein a space is provided between the first emitting unit and the first receiving unit and the first optical signal travels along an optical path from the first emitting unit to the first receiving unit;

an actuation member movably disposed between the first emitting unit and the first receiving unit; and a second optical sensor, disposed below the first optical sensor, the second optical sensor comprising a second emitting unit configured to emit a second optical signal and a second receiving unit configured to receive the second optical signal; wherein a space is provided between the second emitting unit and the second receiving unit;

wherein the actuation member in a first position interrupts the optical path of the first optical signal; and the actuation member is moved by the waste toner container to a second position when at least a part of the waste toner container is placed in the space between the first emitting unit and the first receiving unit, wherein the actuation member in the second position allows a passage of the first optical signal.

2. The detection device of claim 1, wherein the actuation member is formed with an aperture and pivotally mounted for pivotal movement; wherein as the actuation member is moved by the waste toner container to the second position, the aperture moves into the optical path of the first optical signal and the first optical signal passes through the aperture.

3. The detection device of claim 1, further comprising an elastic connecting member which connects the actuation member and a frame, wherein by the elastic connecting member the actuation member is flexibly disposed between the first emitting unit and the first receiving unit; wherein in the second position the actuation member is out of the optical path of the first optical signal and allows the passage of the first optical signal.

4. The detection device of claim 1, wherein the presence of the waste toner container is detected if the first receiving unit receives the first optical signal; and the absence of the waste toner container, or a full state in the waste toner container, is detected if the first receiving unit receives no first optical signal.

5. The detection device of claim 1, wherein the absence of the waste toner container is detected if the first receiving unit receives no first optical signal and the second receiving unit receives the second optical signal.

6. The detection device of claim 1, wherein the presence of the waste toner container is detected if the first receiving unit and the second receiving unit receive the first optical signal and the second optical signal respectively.

7. The detection device of claim 1, wherein a nearly full state in the waste toner container is detected if the first receiving unit receives the first optical signal and the second receiving unit receives no second optical signal.

8. The detection device of claim 1, wherein a full state in the waste toner container is detected if neither of the first receiving unit and the second receiving unit receives the optical signal.

9. An image forming apparatus comprising:

a printing engine;

a waste toner container, detachably disposed, for storing a waste toner removed from the printing engine; and a detection device for detecting a state of the waste toner container, comprising:

a first optical sensor comprising a first emitting unit configured to emit a first optical signal and a first receiving unit configured to receive the first optical signal, wherein a space is provided between the first emitting unit and the first receiving unit, and the first optical signal travels along an optical path from the first emitting unit to the first receiving unit;

an actuation member movably disposed between the first emitting unit and the first receiving unit; and a second optical sensor, disposed below the first optical sensor, the second optical sensor comprising a second emitting unit configured to emit a second optical signal and a second receiving unit configured to receive the second optical signal; wherein a space is provided between the second emitting unit and the second receiving unit;

wherein the actuation member in a first position interrupts the optical path of the first optical signal; and the actuation member is moved by the waste toner container to a second position when the waste toner container is in an installed position, wherein the actuation member in the second position allows a passage of the first optical signal.

10. The image forming apparatus of claim 9, further comprising a processor used for determining the state of the waste toner container according to the detection results of the detection device.

11. The image forming apparatus of claim 9, wherein the actuation member is formed with an aperture and pivotally mounted for pivotal movement; wherein as the actuation member is moved by the waste toner container to the second position, the aperture moves into the optical path of the first optical signal and the first optical signal passes through the aperture.

12. The image forming apparatus of claim 9, wherein the detection device further comprises an elastic connecting member which connects the actuation member to a frame of the image forming apparatus, wherein by the elastic connecting member the actuation member is flexibly disposed between the first emitting unit and the first receiving unit; wherein in the second position the actuation member is out of the optical path of the first optical signal and allows the passage of the first optical signal.

13. The image forming apparatus of claim 9, wherein the waste toner container in the installed position is detected if the first receiving unit receives the first optical signal.

14. The image forming apparatus of claim 9, wherein the absence of the waste toner container in the installed position, or a full state in the waste toner container, is detected if the first receiving unit receives no first optical signal.

15. The image forming apparatus of claim 9, wherein the absence of the waste toner container in the installed position is detected if the first receiving unit receives no first optical signal and the second receiving unit receives the second optical signal.

16. The image forming apparatus of claim 9, wherein the waste toner container in the installed position is detected if the first receiving unit and the second receiving unit receive the first optical signal and the second optical signal respectively.

17. The image forming apparatus of claim 9, wherein a nearly full state in the waste toner container is detected if the first receiving unit receives the first optical signal and the second receiving unit receives no second optical signal.

18. The image forming apparatus of claim 9, wherein a full state in the waste toner container is detected if neither of the first receiving unit and the second receiving unit receives the optical signal.

* * * * *